US009739288B2

(12) United States Patent
Huang et al.

(10) Patent No.: US 9,739,288 B2
(45) Date of Patent: Aug. 22, 2017

(54) FAN HUB BALANCING STRUCTURE

(71) Applicant: ASIA VITAL COMPONENTS CO., LTD., New Taipei (TW)

(72) Inventors: Chun-Hao Huang, New Taipei (TW); Chun-Liang Ho, New Taipei (TW)

(73) Assignee: ASIA VITAL COMPONENTS CO., LTD., New Taipei ( * ) Notice: Subject to any disclaimer, the term of this patent is extended or adjusted under 35 U.S.C. 154(b) by 345 days.

(21) Appl. No.: 14/510,127

(22) Filed: Oct. 9, 2014

(65) Prior Publication Data

US 2016/0102680 A1 Apr. 14, 2016

(51) Int. Cl.
*F04D 29/66* (2006.01)
*F04D 25/06* (2006.01)

(52) U.S. Cl.
CPC ..... *F04D 29/662* (2013.01); *F04D 25/0613* (2013.01)

(58) Field of Classification Search
CPC ..... F04D 25/663; F04D 29/662
See application file for complete search history.

(56) References Cited

U.S. PATENT DOCUMENTS 7,025,570 B2 * 4/2006 Jung ..... F04D 29/164 416/144
7,305,905 B2 * 12/2007 Rocky ..... F16F 15/32 416/144
9,284,961 B2 * 3/2016 Mashima ..... F04D 19/002
2005/0249596 A1 * 11/2005 Hsieh ..... F04D 29/662 416/144
2006/0269412 A1 * 11/2006 Yu ..... F04D 29/329 416/144
2008/0056899 A1 * 3/2008 Jiang ..... F01D 5/22 416/186 R
2008/0063526 A1 * 3/2008 He ..... F04D 25/0613 416/144
2008/0075596 A1 * 3/2008 Kitamura ..... F04D 29/662 416/145
2011/0236211 A1 * 9/2011 Schneider ..... F04D 29/662 416/144

* cited by examiner

*Primary Examiner* — Woody Lee, Jr.

(57) ABSTRACT

A fan hub balancing structure includes a hub main body. The hub main body has a top section, a circumferential section extending from the circumference of the top section and a lip section. The lip section is connected with the lower end of the circumferential section. The lip section has at least one residual weight section on the lip section. After the residual weight section is removed from the lip section, a balancing section is formed on the lip section. The balancing structure is able to provide a balancing effect for the hub main body and facilitate the processing of the hub main body.

9 Claims, 11 Drawing Sheets

FAN HUB BALANCING STRUCTURE

BACKGROUND OF THE INVENTION

1. Field of the Invention

The present invention relates generally to a fan hub balancing structure, and more particularly to a fan hub balancing structure in which the residual weight sections are removed from the hub main body by means of punching or perforating the lip section of the hub main body so as to provide a balancing effect for the hub main body.

2. Description of the Related Art

The hubs of the conventional computer fans are generally made of metal material or plastic material. In the manufacturing process of the fan, in order to operate the fan in an optimal balanced state without unnecessary vibration, a defective product is processed in a reduce-to-balance manner. That is, the residual weight sections of the hub are removed from the hub so as to balance the hub. With a metal-made (such as iron-made) hub taken as an example, a conventional metal-made hub is punched and molded by a mold. When punched by the mold, the metal hub can hardly have a uniform thickness. Therefore, after molded, the metal hub will have non-uniform weight. As a result, the metal hub will be over-unbalanced. In order to solve the problem of unbalance of the metal hub, the punch mold is rectified to adjust the geometrical tolerance (such as the concentricity, the run-out and the perpendicularity) so as to improve the unbalance amount of the molded metal hub.

However, the above method can hardly effectively improve the unbalance amount of the metal hub. This is because the weight of the surface of the top section and the weight of the surface of the circumferential section of the metal hub are not substantially decreased or increased. The punch mold is simply shifted and adjusted so that the unbalance amount can be hardly improved.

In the conventional metal hub balancing structure, a mold is used to punch the top section 11 of the metal hub 1 so as to remove the material of the over-weighing angular position. This can provide a balancing effect for the metal hub 1. The unbalance amount of the metal hub 1 can be improved by means of the above punching method. However, this leads to another problem. That is, the top section 11 of the metal hub 1 is formed with a central opening 111 for a shaft to insert therein. A recess 113 is formed around the opening 111. Therefore, when punching the top section 11 of the metal hub 1 to remove the material from the top section 11 so as to balance the metal hub 1, due to the affection of the recess 113, the total structural strength of the top section 11 will be deteriorated.

In addition, the current punch mold has an upper punch mold section and a lower punch mold section. Therefore, the surface of the circumferential section 12 of the metal hub 1 cannot be punched to improve the unbalance amount of the metal hub 1. In the case that the circumferential section 12 of the metal hub 1 is 90-degree turned to make a circumferential surface and an opposite circumferential surface of the circumferential section 12 respectively face the upper and lower punch mold sections of the punch mold, neither the inner side of the circumferential surface of the circumferential section 12 nor the inner side of the opposite circumferential surface of the circumferential section 12 is supported by any support article. As a result, when the circumferential surface of the circumferential section 12 is punched by the upper punch mold section, the entire circumferential section 12 of the metal hub 1 will be seriously deformed and the perforations will have burrs. In some more serious cases, the magnets received in the metal hub may be scraped or deformed by the burrs of the perforations.

It is therefore tried by the applicant to provide a fan hub balancing structure to overcome the problems of the conventional structure. The fan hub balancing structure of the present invention is able to provide a balancing effect for the hub main body without increasing the thickness of the hub main body so as to meet the requirement of lightweight and slimness or deteriorating the structural strength of the top section and the circumferential section of the hub main body.

SUMMARY OF THE INVENTION

It is therefore a primary object of the present invention to provide a fan hub balancing structure, which is able to provide balancing effect for the hub main body.

It is a further object of the present invention to provide the above fan hub balancing structure, which can facilitate the processing of the hub main body.

To achieve the above and other objects, the fan hub balancing structure of the present invention includes a hub main body. The hub main body has a top section, a circumferential section and a lip section. The circumferential section has an upper end and a lower end. The upper end is connected with a circumference of the top section. The lower end is connected with inner circumference of the lip section. The circumferential section and the top section together define a receiving space. The lip section outward extends from the lower end in a direction away from a center of the hub. The lip section has at least one residual weight section on the lip section. After the residual weight section is removed from the lip section, a balancing section is formed on the lip section. The balancing structure is able to provide a balancing effect for the hub main body and facilitate the processing of the hub main body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
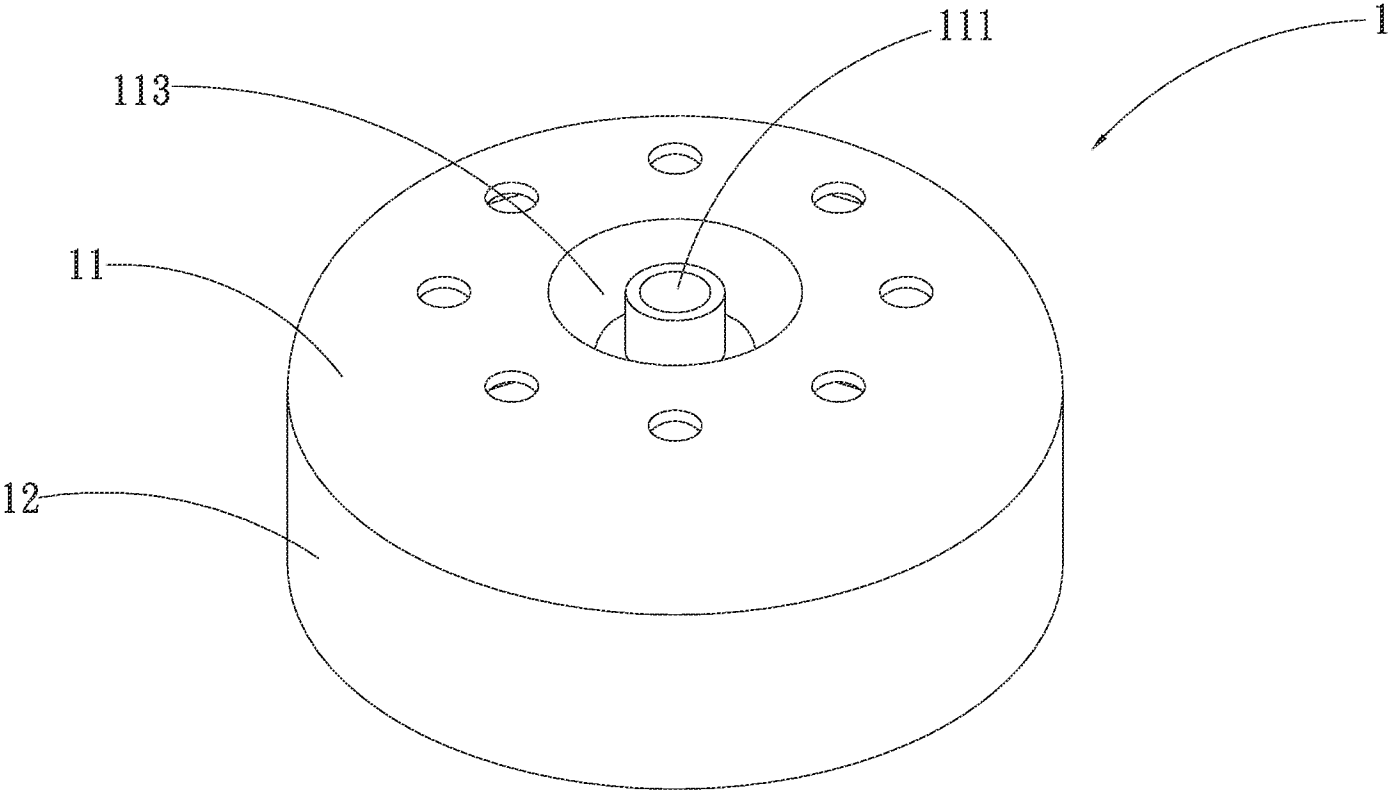
(PRIOR ART) Fig. 1A
FIG. 1A is a perspective view of a conventional structure.
Figure 1B:
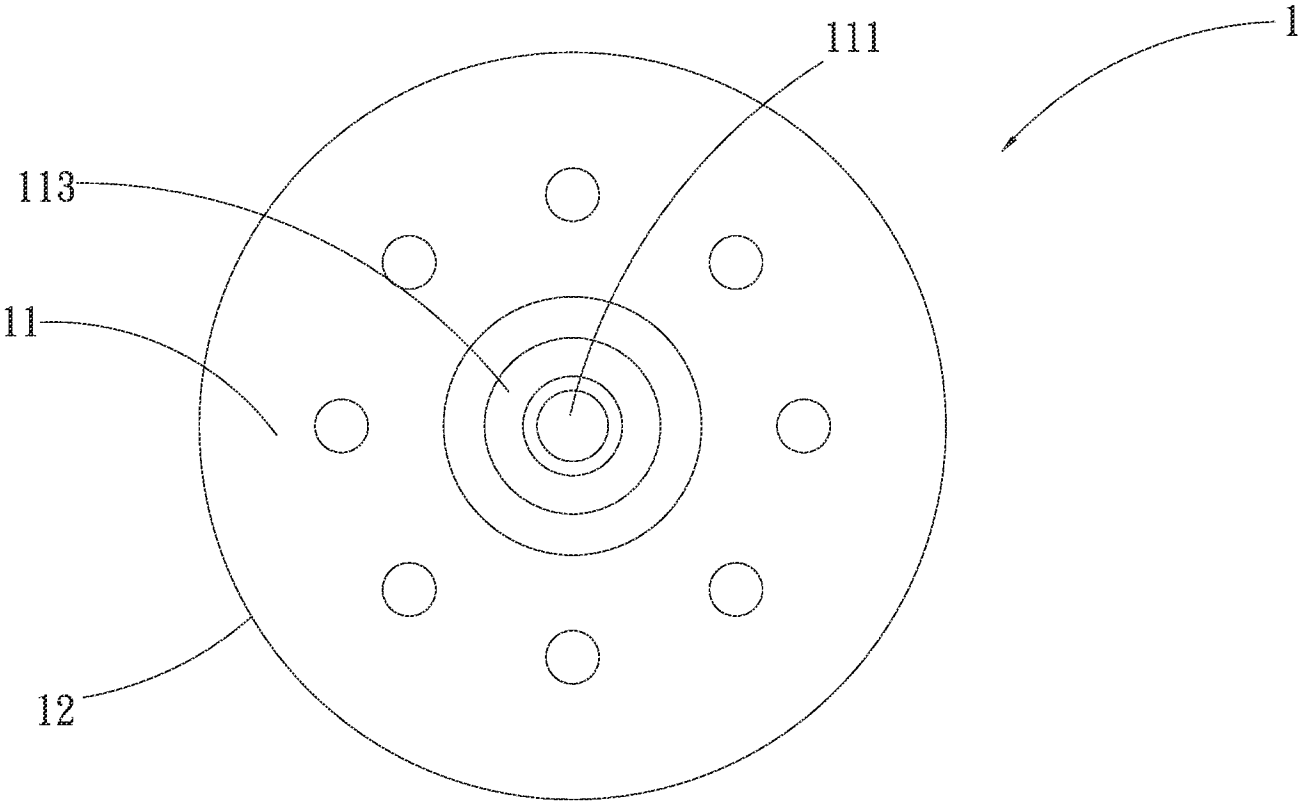
(PRIOR ART) Fig. 1B
FIG. 1B is a top view of the conventional structure.
Figure 2:
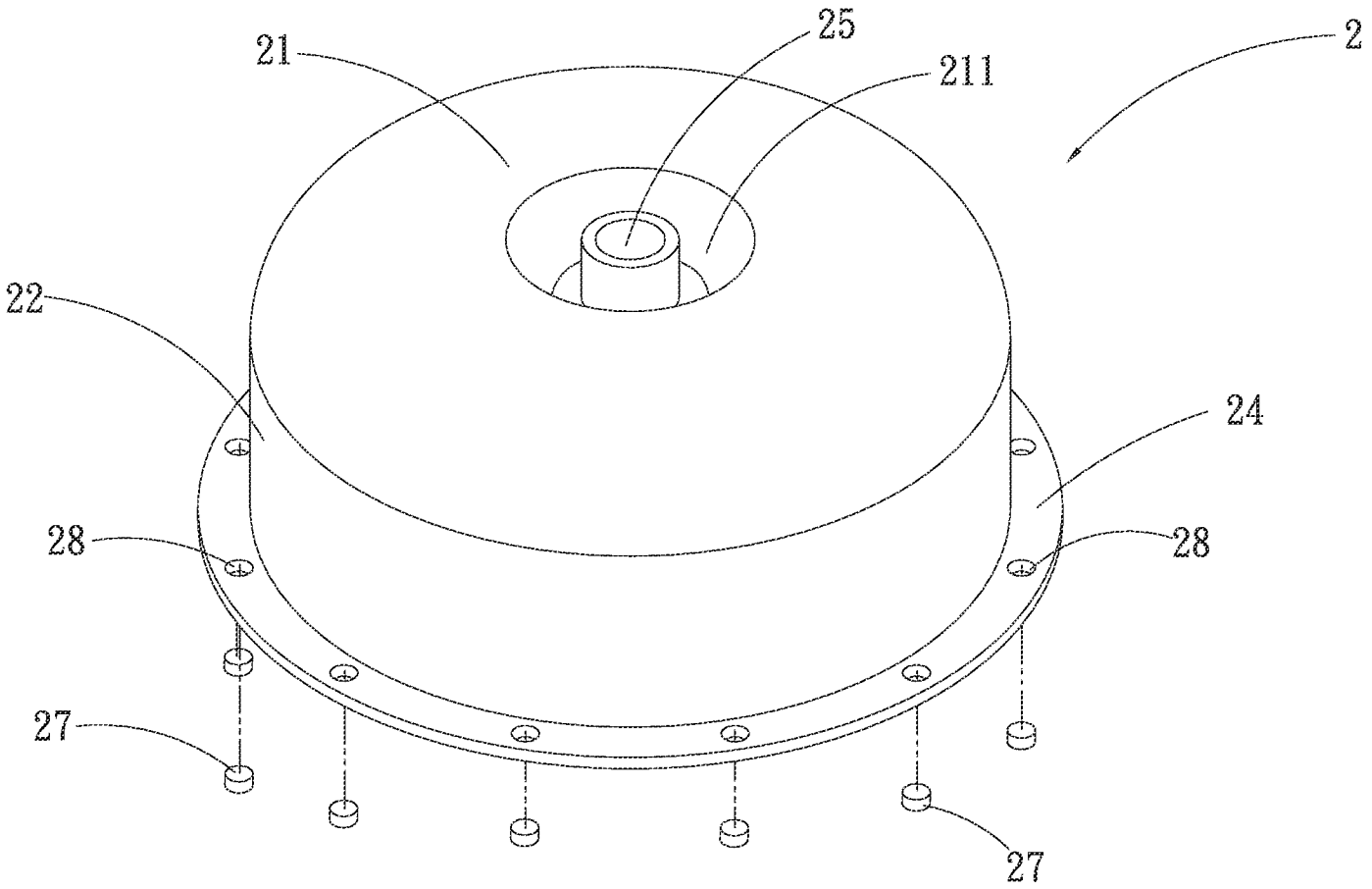
FIG. 2 is a perspective view of a first embodiment of the present invention.
Figure 3:
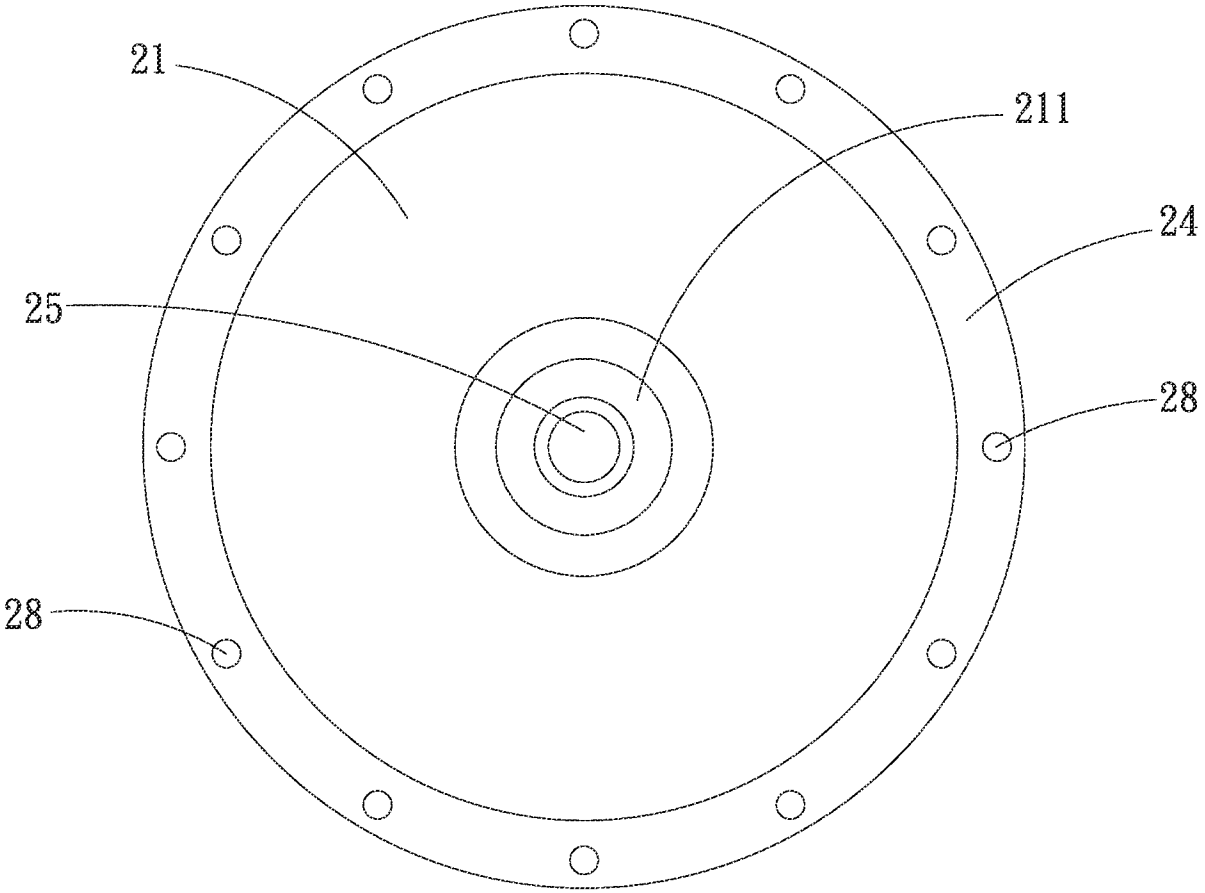
FIG. 3 is a top view of the first embodiment of the present invention.
Figure 4:
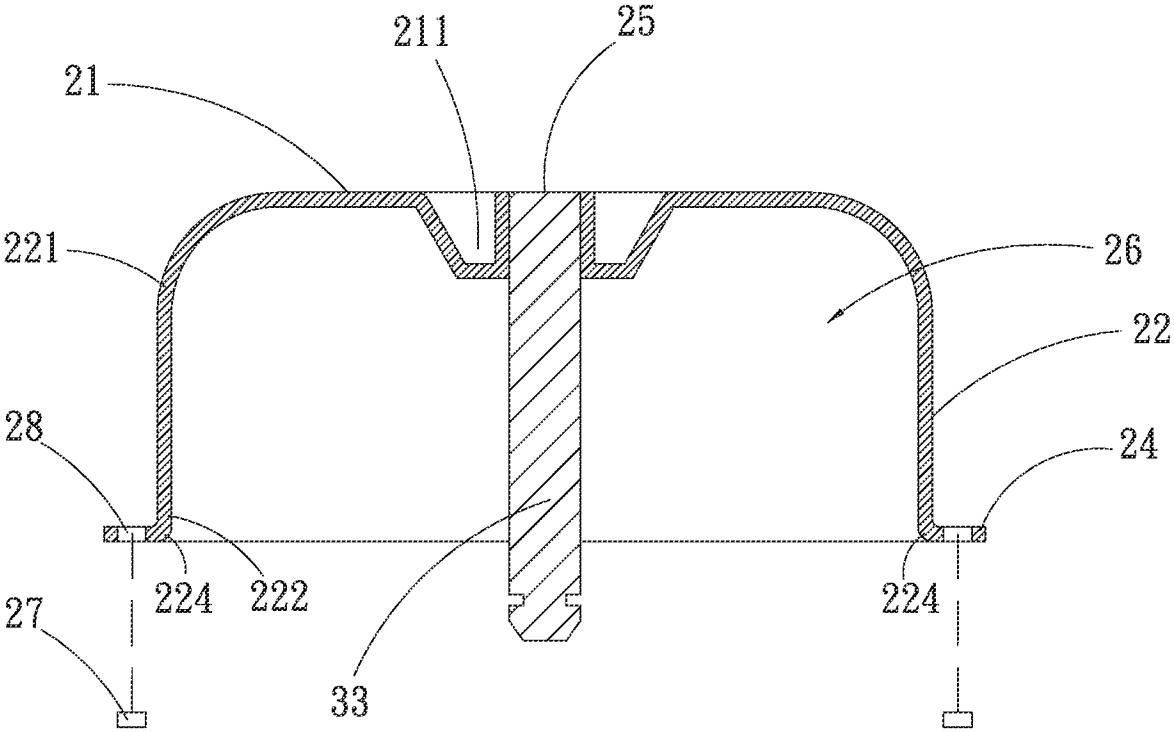
FIG. 4 is a sectional view of the first embodiment of the present invention.

Please refer to FIGS. 2 and 3 and also refer to FIG. 4. FIG. 2 is a perspective view of a first embodiment of the present invention. FIG. 3 is a top view of the first embodiment of the present invention. FIG. 4 is a sectional view of the first embodiment of the present invention. According to the first embodiment, the fan hub balancing structure of the present invention includes a hub main body 2. The hub main body 2 is made of metal material (such as iron and aluminum). The hub main body 2 has a top section 21, a circumferential section 22, a lip section 24 and an opening 25. The opening 25 is formed at the center of the top section 21 for a shaft 33 to insert therein. That is, one end of the shaft 33 is inserted in the opening 25, while the other end of the shaft 33 is received in a receiving space 26 of the hub main body 2. The circumferential section 22 has an upper end 221 and a lower end 222. The lower end 222 has a bending section 224. The lower end 222 of the circumferential section 22 is outward bent to form the bending section 224.

The upper end 221 is connected with the circumference of the top section 21. The lower end 222 is connected with inner circumference of the lip section 24. The circumferential section 22 downward perpendicularly extends from the circumference of the top section 21. (That is, the circumferential section 22 downward perpendicularly extends from the circumference of the top section 21 in a direction away from the top section 21). The lower end of the circumferential section 22 is bent to form the bending section 224. The bending section 224 extends to connect with the inner circumference of the lip section 24. The top section 21, the circumferential section 22 and the lip section 24 are integrally connected to form the hub main body 2.

The circumferential section 22 and the top section 21 together define the receiving space 26 in communication with the opening 25. The top section 21 is formed with a substantially trapezoidal recess 211. A section of the top section 21 around the opening 25 is recessed toward the lower end 222 of the circumferential section 22 to form the recess 211. The depth of the opening 25 is varied with the depth of the recess 211. The lip section 24 outward extends from the lower end 222 in a direction away from the center of the hub. In this embodiment, an angle is contained between one face of the lip section 24 and the outer face of the circumferential section 22. The angle is, but not limited to, 90 degrees for illustration purposes only. In practice, according to the requirement of arrangement space and position, the angle can be adjusted to such as 45 degrees, 60 degrees, 120 degrees or 135 degrees.

Please further refer to FIGS. 2 and 4. The lip section 24 has at least one residual weight section 27 on the lip section 24. The residual weight section 27 is removed from the lip section 24 to form a balancing section 28 on the lip section 24. In this embodiment, the residual weight section 27 is removed from the lip section 24 by means of mechanical processing. For example, the upper and lower punch mold sections of a mold (not shown) are used to punch (or perforate) the lip section 24 to remove the residual weight section 27 from the lip section 24 to form the balancing section 28. Accordingly, the hub main body 2 can be balanced.

The balancing section 28 is a perforation formed through the lip section 24 between the inner circumference of the lip section 24 and an outer circumference of the lip section 24. That is, the perforation (the balancing section 28) is formed through the lip section 24 from upper side of the lip section 24 proximal to the outer face of the circumferential section 22 to the lower side of the lip section 24. In this embodiment, the number of the residual weight sections 27 is, but not limited to, 12 for illustration purposes only. In practice, the number of the residual weight sections 27 is determined by the unbalanced amount of the hub main body 2. In addition, the number of the residual weight sections 27 is equal to the number of the balancing sections 28. For example, in case that the number of the residual weight sections 27 is 5, then the number of the balancing sections 28 is also 5.

According to the above arrangement, the lip section 24 extending from the circumferential section 22 is punched (or perforated) to remove the residual weight sections 27 so as to deduct residual material from the lip section 24 as necessary. After the residual weight sections 27 are removed from the lip section 24, the balancing sections 28 are formed on the lip section 24. The top section 21 and the circumferential section 22 of the hub main body 2 are not punched so that a balancing effect for the hub main body 2 can be achieved without deteriorating the structural strength of the top section 21 and the circumferential section 22 of the hub main body 2. In addition, the working time is shortened and the cost is lowered. Also, the processing is facilitated. In other words, the structural design of the present invention overcomes the shortcoming of poor structural strength of the top section 21 and the circumferential section 22 of the conventional structure. Also, the problems that the circumferential section 22 is deformed and the perforations have burrs are solved.

Figure 5:
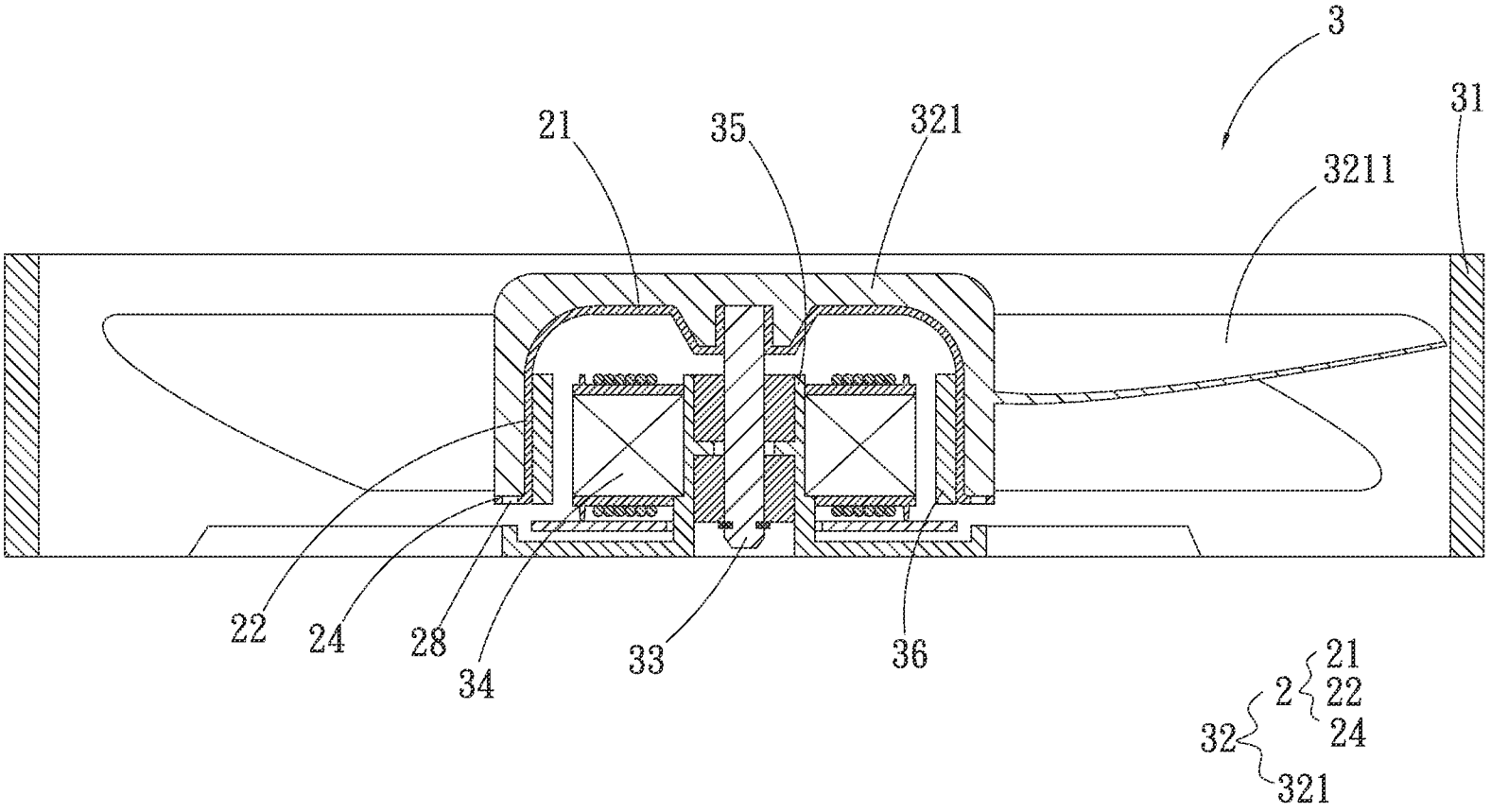
FIG. 5 is a sectional view of a second embodiment of the present invention.

Please now refer to FIGS. 2, 4 and 5. FIG. 5 is a sectional view of a second embodiment of the present invention. In this embodiment, the fan hub balancing structure of the present invention is applied to the fan impeller 32 of a fan 3. The fan 3 includes a fan impeller 32, a fan frame 31, a stator 34 and a bearing cup 35. The bearing cup 35 is disposed at the center of the fan frame 31. The other end of the shaft 33 is rotatably disposed in the bearing cup 35. The stator 34 is fitted around the bearing cup 35. The fan impeller 32 includes a blade assembly 321 having multiple blades 3211 and the hub main body 2. The blade assembly 321 is formed of plastic material and integrally formed on outer circumference of the hub main body 2 by injection molding to form the fan impeller 32. In short, the blade assembly 321 and the hub main body 2 are integrally molded to form the fan impeller 32. The fan impeller 32 is received in the fan frame 31 to enclose the stator 34 around the bearing cup 35. When powered on, the stator 34 is magnetized to interact with a magnetic member 36 disposed in the hub main body 2.

The hub main body 2 of the present invention is applied to the fan impeller 32, whereby the fan impeller 32 can be rotated in a balanced state without swinging and without deteriorating the structural strength of the top section 21 and the circumferential section 22 of the hub main body 2. In addition, the working time is shortened and the cost is lowered. Also, the processing is facilitated.

Figure 6:
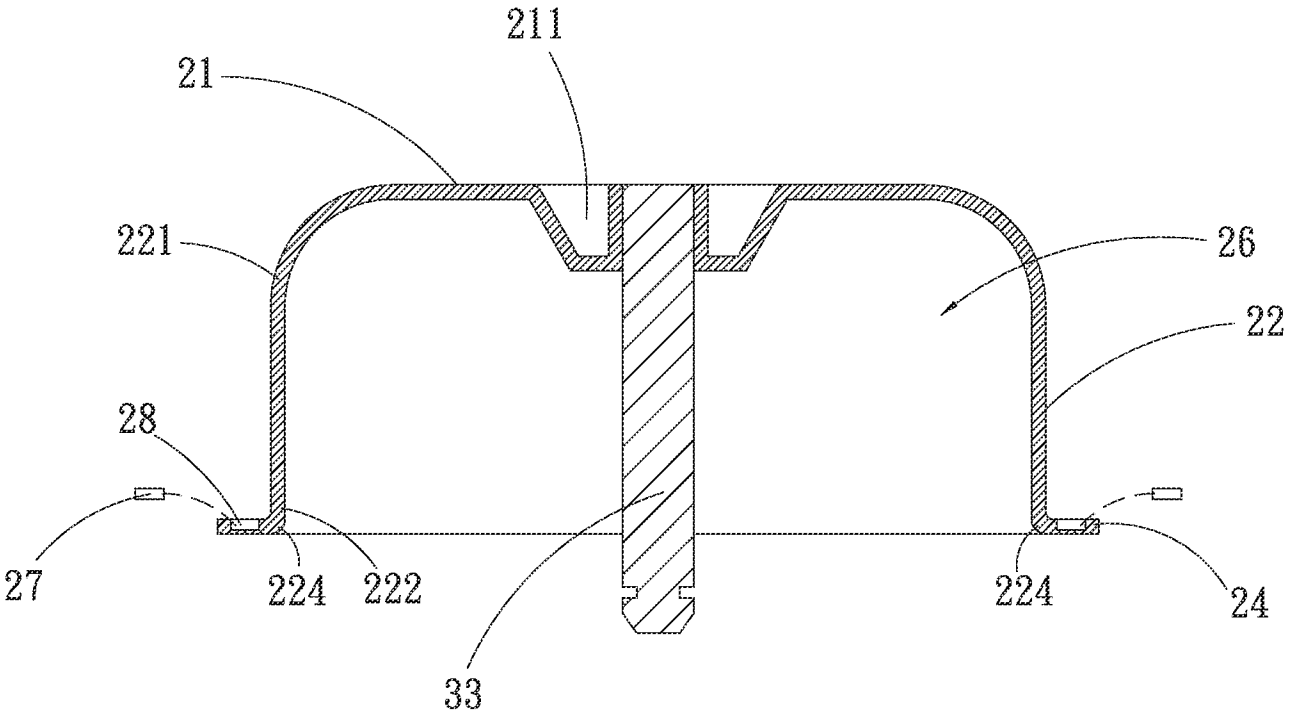
FIG. 6 is a sectional view of a third embodiment of the present invention.

Please now refer to FIG. 6, which is a sectional view of a third embodiment of the present invention. The third embodiment is substantially identical to the first embodiment in structure, connection relationship and effect and thus will not be repeatedly described hereinafter. The third embodiment is different from the first embodiment in that the balancing section 28 is a recess instead of the perforation. The balancing section 28 is formed on the upper face of the lip section 24 proximal to the outer circumference of the circumferential section 22 and positioned between the inner circumference of the lip section 24 and the outer circumference of the lip section 24. In other words, the recess (the balancing section 28) is recessed from the upper face of the lip section 24 toward the lower face of the lip section 24 without penetrating through the lip section 24 to the lower face thereof.

After the residual weight sections 27 are removed from the lip section 24 by means of mechanical processing such as by means of a drill bit (or a milling cutter) of a mold (not shown), the residual materials of the lip section 24 are removed from the lip section 24 to form the balancing sections 28 as the recesses. A balancing effect for the hub main body 2 can be achieved without deteriorating the structural strength of the top section 21 and the circumferential section 22 of the hub main body 2. In addition, the working time is shortened and the cost is lowered. Also, the processing is facilitated. In other words, the structural design of the present invention overcomes the shortcoming of poor structural strength of the top section 21 and the circumferential section 22 of the conventional metal-made hub. Also, the problems that the circumferential section 22 is deformed and the perforations have burrs are solved.

Figure 7:
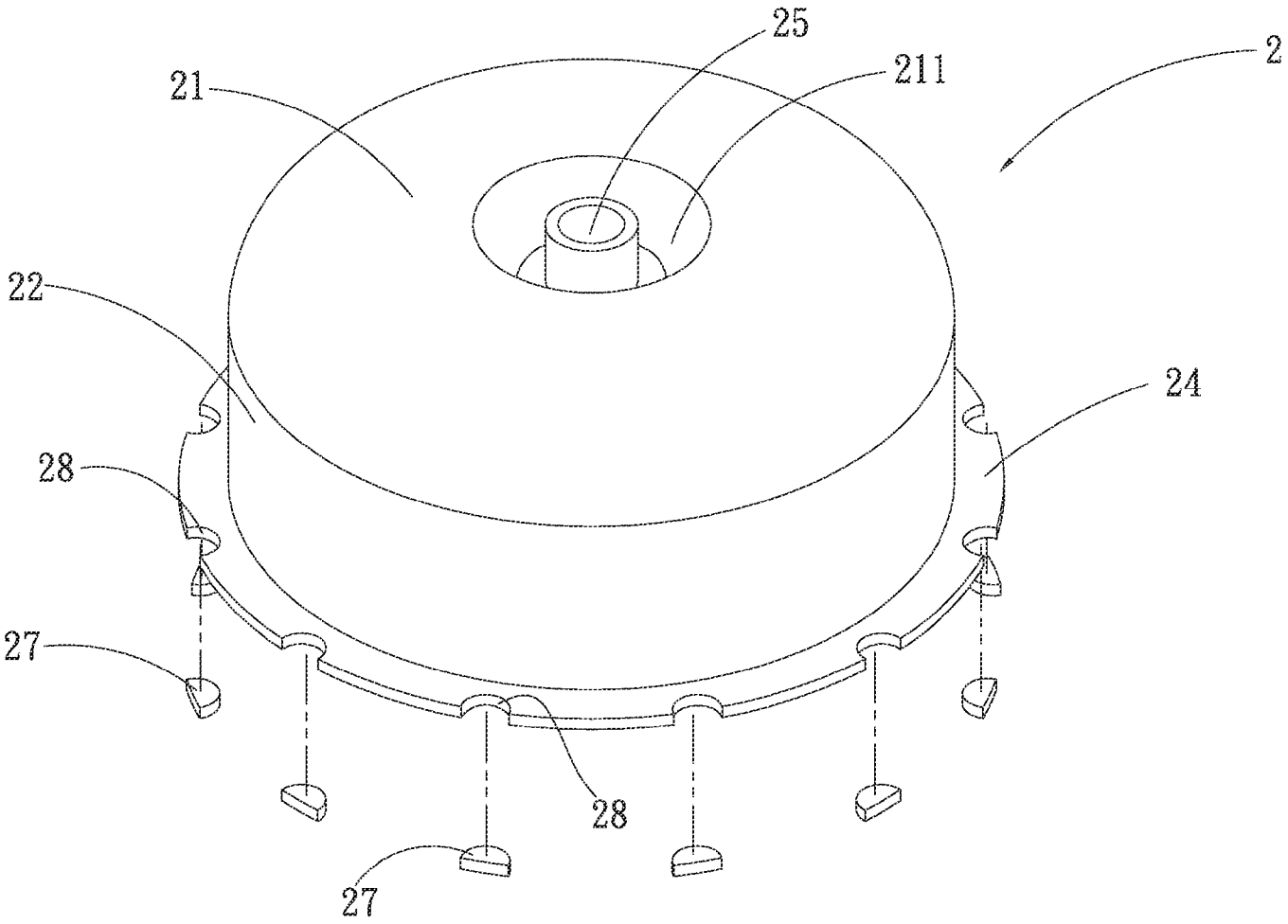
FIG. 7 is a perspective view of a fourth embodiment of the present invention.
Figure 8:
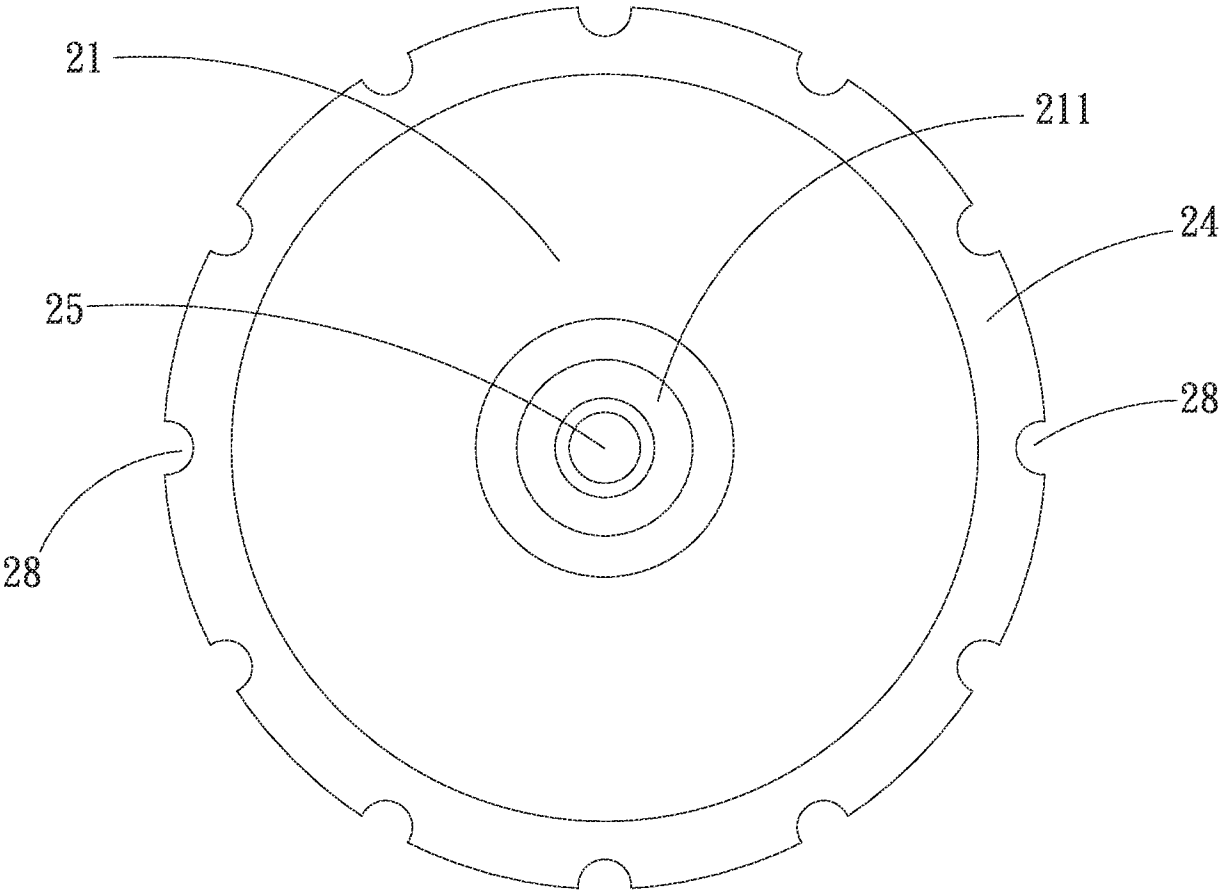
FIG. 8 is a top view of the fourth embodiment of the present invention.
Figure 9:
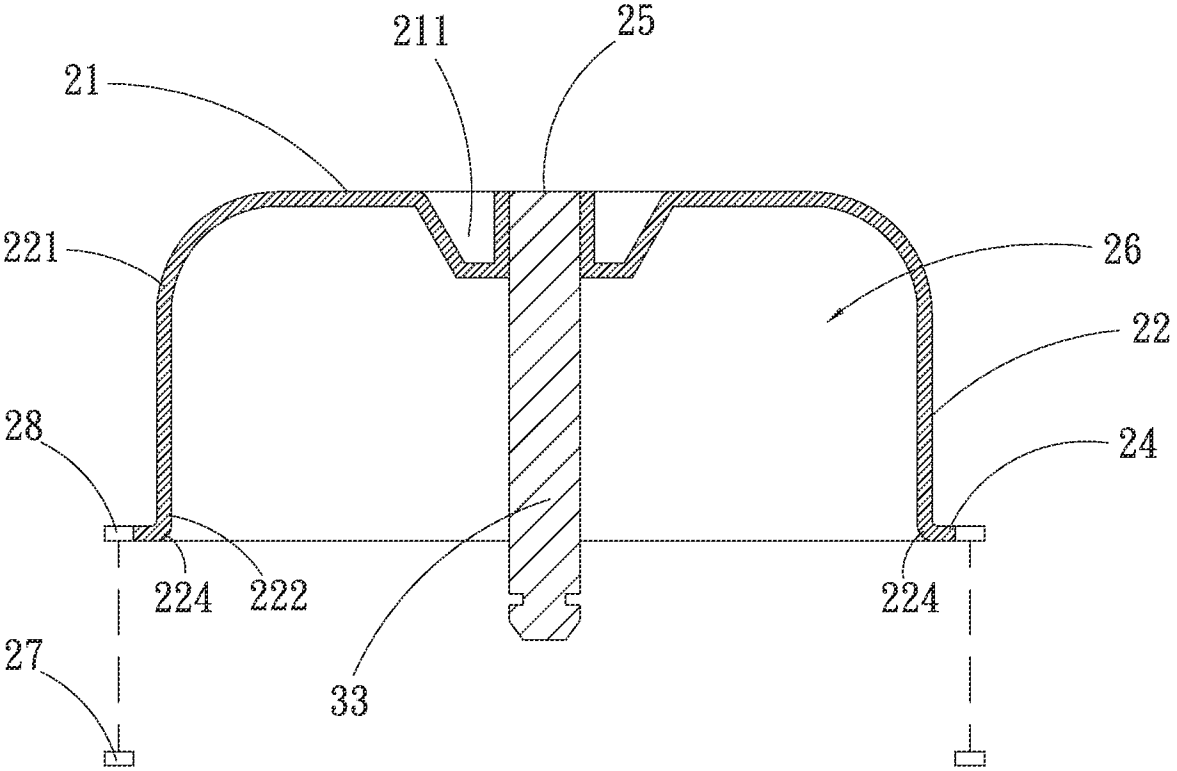
FIG. 9 is a sectional view of the fourth embodiment of the present invention.

Please now refer to FIGS. 7, 8 and 9. FIG. 7 is a perspective view of a fourth embodiment of the present invention. FIG. 8 is a top view of the fourth embodiment of the present invention. FIG. 9 is a sectional view of the fourth embodiment of the present invention. The fourth embodiment is substantially identical to the first embodiment in structure, connection relationship and effect and thus will not be repeatedly described hereinafter. The fourth embodiment is different from the first embodiment in that the balancing section 28 is a perforation formed through the lip section 24 and concaved from the outer circumference of the lip section 24 toward the inner circumference of the lip section 24. That is, the perforation (the balancing section 28) is formed through the lip section 24 from the upper face of the lip section 24 proximal to the circumferential section 22 to the lower face of the lip section 24 and is concaved from the outer circumference of the lip section 24 toward the inner circumference of the lip section 24.

After the residual weight sections 27 are removed from the lip section 24 by means of mechanical processing such as by means of using the upper and lower punch mold sections of a mold (not shown) to punch (or perforate) the lip section 24, the residual materials of the lip section 24 are removed from the lip section 24 to form the balancing sections 28. In this case, a balancing effect for the hub main body 2 can be achieved without deteriorating the structural strength of the top section 21 and the circumferential section 22 of the hub main body 2. In addition, the working time is shortened and the cost is lowered. Also, the processing is facilitated. In other words, the structural design of the present invention overcomes the shortcoming of poor structural strength of the top section 21 and the circumferential section 22 of the conventional metal-made hub. Also, the problems that the circumferential section 22 is deformed and the perforations have burrs are solved.

Figure 10:
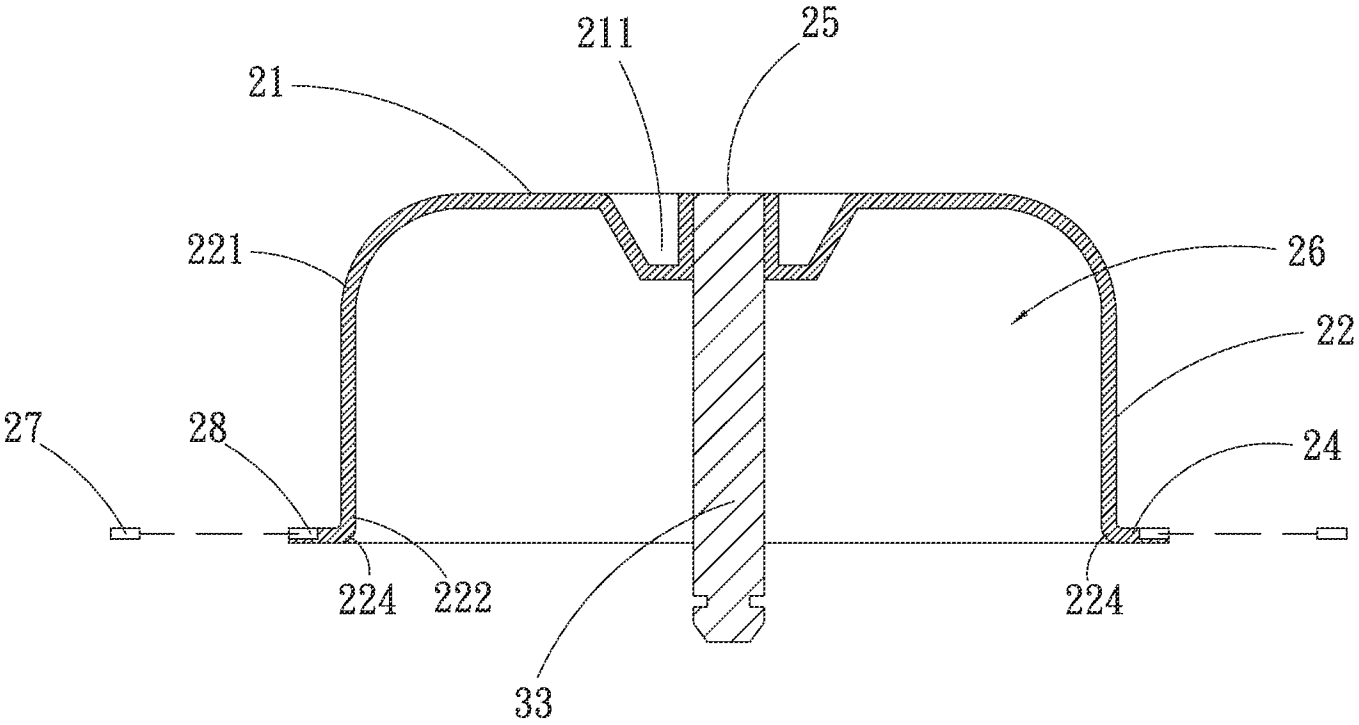
FIG. 10 is a sectional view of a fifth embodiment of the present invention.

Please now refer to FIG. 10, which is a sectional view of a fifth embodiment of the present invention. The fifth embodiment is substantially identical to the fourth embodiment in structure, connection relationship and effect and thus will not be repeatedly described hereinafter. The fifth embodiment is different from the fourth embodiment in that the balancing section 28 is a recess instead of the perforation. The recess (the balancing section 28) is formed on the upper face of the lip section 24 proximal to the outer circumference of the circumferential section 22 and extending from the outer circumference of the lip section 24 toward the inner circumference of the lip section 24 without penetrating through the lip section 24 to the lower face thereof.

After the residual weight sections 27 are removed from the lip section 24 by means of mechanical processing such as by means of a drill bit (or a milling cutter) of a mold (not shown), the residual materials of the lip section 24 are removed from the lip section 24 to form the balancing sections 28 as the recesses. A balancing effect for the hub main body 2 can be achieved without deteriorating the structural strength of the top section 21 and the circumferential section 22 of the hub main body 2. In addition, the working time is shortened and the cost is lowered. Also, the processing is facilitated. In other words, the structural design of the present invention overcomes the shortcoming of poor structural strength of the top section 21 and the circumferential section 22 of the conventional metal-made hub. Also, the problems that the circumferential section 22 is deformed and the perforations have burrs are solved.

In conclusion, in comparison with the conventional structure, the present invention has the following advantages:

1. The present invention provides a balancing effect for the hub main body.
2. The structural design of the present invention overcomes the shortcoming of poor structural strength of the top section and the circumferential section of the conventional metal-made hub. Also, the problems that the circumferential section is deformed and the perforations have burrs are solved.
3. The working time is shortened and the cost is lowered. Also, the processing is facilitated.

The present invention has been described with the above embodiments thereof and it is understood that many changes and modifications in the above embodiments can be carried out without departing from the scope and the spirit of the invention that is intended to be limited only by the appended claims.

What is claimed is:

1. A fan hub balancing structure comprising a hub main body, the hub main body having a top section, a circumferential section and a lip section, the circumferential section having an upper end and a lower end, the upper end being connected with a circumference of the top section, the lower end being connected with an inner circumference of the lip section, the circumferential section and the top section together defining a receiving space, the lip section outward extending from the lower end in a direction away from a center of the hub, the lip section having at least one residual weight section on the lip section, after the residual weight section is removed from the lip section, a balancing section being formed on the lip section; wherein the balancing section is a perforation formed through the lip section from an upper face to a lower face of the lip section.

2. The fan hub balancing structure as claimed in claim 1, wherein the lower end of the circumferential section has a bending section, the lower end of the circumferential section being outward bent to form the bending section, the bending section extending to connect with the inner circumference of the lip section.

3. The fan hub balancing structure as claimed in claim 1, wherein the balancing section is formed between the inner circumference of the lip section and the outer circumference of the lip section.

4. The fan hub balancing structure as claimed in claim 1, wherein the balancing section is concaved from the outer circumference of the lip section toward the inner circumference of the lip section.

5. The fan hub balancing structure as claimed in claim 1, wherein the hub main body further has an opening, the opening being formed at a center of the top section for a shaft to insert therein, one end of the shaft being inserted in the opening, while the other end of the shaft being received in a receiving space.

6. The fan hub balancing structure as claimed in claim 1, wherein a plastic-made blade assembly is formed around the hub main body to enclose the hub main body, the blade assembly and the hub main body being integrally molded to form a fan impeller, the fan impeller being received in a fan frame of a fan.

7. The fan hub balancing structure as claimed in claim 1, wherein the hub main body is made of metal material.

8. The fan hub balancing structure as claimed in claim 1, wherein the top section and the circumferential section and the lip section are integrally molded to form the hub main body.

9. A fan hub balancing structure comprising a hub main body, the hub main body having a top section, a circumferential section and a lip section, the circumferential section having a upper end and a lower end, the upper end being connected with a circumference of the top section, the lower end being connected with an inner circumference of the lip section, the circumferential section and the top section together defining a receiving space, the lip section outward extending from the lower end in a direction away from a center of the hub, the lip section having at least one residual weight section on the lip section, after the residual weight section is removed from the lip section, a balancing section being formed on the lip section; wherein the balancing section is formed through the lip section from an upper face of the lip section proximal to an outer circumference of the circumferential section to an outer circumference of the lip section.

* * * * *